US007192316B1

(12) United States Patent
Pollmann

(10) Patent No.: US 7,192,316 B1
(45) Date of Patent: Mar. 20, 2007

(54) ELECTRICAL CONNECTING TERMINAL

(75) Inventor: Carsten Pollmann, Steinheim (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 11/466,035

(22) Filed: Aug. 21, 2006

(30) Foreign Application Priority Data

Aug. 26, 2005 (DE) ..... 10 2005 040 657

(51) Int. Cl.
*H01R 9/26* (2006.01)

(52) U.S. Cl. ..... 439/716

(58) Field of Classification Search ..... 439/715–717, 439/417

See application file for complete search history.

(56) References Cited

U.S. PATENT DOCUMENTS 4,236,780 A * 12/1980 Stenz et al. ..... 439/716
4,270,835 A * 6/1981 Kordt et al. ..... 439/94
4,795,376 A * 1/1989 Franke et al. ..... 439/715
4,872,092 A * 10/1989 Lush et al. ..... 361/823
4,940,431 A * 7/1990 Hennemann ..... 439/716
5,049,094 A * 9/1991 Heng et al. ..... 439/716
5,071,356 A * 12/1991 Strate et al. ..... 439/49
5,334,054 A * 8/1994 Conrad et al. ..... 439/716
5,588,881 A * 12/1996 Eggert et al. ..... 439/709
5,615,079 A * 3/1997 Eggert et al. ..... 361/637
5,629,831 A * 5/1997 Eggert et al. ..... 361/624
5,651,702 A * 7/1997 Hanning et al. ..... 439/715
5,658,172 A * 8/1997 Schmidt et al. ..... 439/716
5,722,862 A * 3/1998 Glathe et al. ..... 439/709
5,735,700 A * 4/1998 Hohorst ..... 439/98
5,759,071 A * 6/1998 Hanning et al. ..... 439/716
5,848,917 A * 12/1998 Bechaz et al. ..... 439/716
5,853,304 A * 12/1998 Landreau et al. ..... 439/721
6,027,380 A * 2/2000 Hanning et al. ..... 439/716
6,120,315 A * 9/2000 Gaertner et al. ..... 439/395
6,146,213 A * 11/2000 Yoon ..... 439/716
6,183,311 B1 * 2/2001 Suess et al. ..... 439/716
6,241,561 B1 * 6/2001 Zebermann et al. ..... 439/716

(Continued)

FOREIGN PATENT DOCUMENTS

DE 9006085 8/1990

(Continued)

OTHER PUBLICATIONS

Catalogue "Modular Terminal Blocks Clipline", from Phoenix Contact, "Double-Level and Three and Four-Level Terminal Blocks" (3 pages: cover page & pages 44, 45).

*Primary Examiner*—Ross Gushi
(74) *Attorney, Agent, or Firm*—Darby & Darby

(57) ABSTRACT

An electrical connecting terminal with a connecting terminal housing has on its wide side a housing wall and bus bars running one above the other are disposed in the housing configured for connecting conductor connections arranged on opposite sides of the connecting terminal housing. The conductor connections are arranged laterally offset to each other in the longitudinal direction of the bus bars. The bus bars are connectable to each other by mean of an electrical component. To ensure that uncurved plates with the simplest geometry can be used as potential connectors between two bus bars arranged one above the other, at least one bus bar is curved in its course between the conductor connections in the direction of the housing wall.

5 Claims, 4 Drawing Sheets

U.S. PATENT DOCUMENTS

| | | | | |
|---|---|---|---|---|
| 6,392,319 | B1 * | 5/2002 | Zebermann et al. | 307/147 |
| 6,478,605 | B2 * | 11/2002 | Stuckmann et al. | 439/409 |
| 6,488,527 | B2 * | 12/2002 | Yoon | 439/441 |
| 6,500,021 | B2 * | 12/2002 | Wilmes et al. | 439/409 |
| 6,506,071 | B2 * | 1/2003 | Lange | 439/358 |
| 6,655,982 | B2 * | 12/2003 | Bolliger et al. | 439/409 |
| 6,692,292 | B2 * | 2/2004 | Huiskamp et al. | 439/417 |
| 6,733,330 | B2 * | 5/2004 | Prost et al. | 439/532 |
| 6,848,951 | B1 * | 2/2005 | Bechaz et al. | 439/716 |
| 6,916,214 | B2 * | 7/2005 | Conrad | 439/716 |

FOREIGN PATENT DOCUMENTS

| | | |
|---|---|---|
| DE | 19533992 | 2/1997 |
| DE | 69804376 | 1/2000 |
| DE | 20306768 | 9/2004 |
| EP | 0783874 | 3/1997 |
| EP | 0784355 | 7/1997 |

* cited by examiner

ELECTRICAL CONNECTING TERMINAL

Priority is claimed to German Patent Application No. 10 2005 040 657.2, filed on Aug. 26, 2005, the entire disclosure of which is incorporated by reference herein.

The present invention relates to an electrical connecting terminal with a connecting terminal housing in which bus bars running one above the other are mounted for connecting conductor connections arranged on opposing sides of the connecting terminal housing, which connections, viewed in the longitudinal direction of the bus bars, are arranged so that they are laterally offset to each other, wherein the bus bars can be connected to each other by an electrical component.

BACKGROUND

The electrical connecting terminal of prior art, from which the invention derives, is a multistory series terminal, as described, for example in the catalogue "Series Terminals Clipline 2002", from Phoenix Contact, in the left column on page 44. The multistory terminal of prior art has a connecting terminal housing of plastic in which bus bars with conductor connections connected on the end side are mounted in multistory fashion one above the other. The conductor connections are designed as sockets for receiving conductors, which sockets may be firmly clamped by screw connections provided. Housing openings, arranged above these screw connections, are provided on the narrow side of the terminal housing for inserting and fixing electrical conductors.

The lower bus bar and the upper bus bar running above it, with their conductor connections, are arranged laterally offset to each other in the longitudinal direction of the bus bars.

A conductor inserted in the upper conductor connection therefore runs laterally offset to the screw connection of the conductor connection arranged below it. The advantage of this is that the lower screw connections are always freely accessible.

However, the offsetting of the bus bars of the terminal arranged one above the other prevents potential connectors of standard rectilinear design from being used for the electrical connection between the bus bars.

SUMMARY OF THE INVENTION

An object of the present invention is to provide an electrical connecting terminal of the type already mentioned with conductor connections arranged laterally offset to each other, in the longitudinal direction of the conductor connections, so that bus bars arranged one above the other can be connected to each other easily, preferably subsequently.

The present invention provides an electrical connecting terminal with a connecting terminal housing in which bus bars running one above the other are mounted for connecting conductor connections arranged on opposing sides of the connecting terminal housing, which connections, viewed in the longitudinal direction of the bus bars, are arranged so that they are laterally offset to each other, wherein the bus bars can be connected to each other by an electrical component. According to the present invention, at least one bus bar is designed so that it is curved to the left or right in its course between the conductor connections. According to the electrical terminal of the present invention, curved plates with simple geometry may be used as potential connectors between two bus bars arranged one above the other. Conventional connection methods, particularly soldering and screwing methods, may be used for the potential connection.

A preferred embodiment of the electrical terminal according to the present invention provides for the connecting terminal housing and the bus bars to have plug openings that lie vertically flush with each other.

According to this embodiment, detachable bridging devices can be used for the electrical connection of juxtaposed terminals. Moreover, it a subsequent potential connection and test facility may be provided between the bus bars of a terminal running one above the other, since the potential connector is preferably capable of being inserted through the plug openings of the connecting terminal housing and into the plug openings of the bus bars.

In a further embodiment of the invention provision is made for at least one bus bar to be curved in its central region. In the case of bus bars that conventionally run parallel and are arranged centrally in relation to their longitudinal and transverse direction, this ensures that a potential connector of the standard rectilinear design contacts the two bus bars in their central region between the conductor connectors. In this way the installation space between the two conductor connections can be made small.

Specifically there are multiple possibilities of designing and developing the electrical connecting terminal according to the invention. Reference is made in this connection to the claims and to the exemplary embodiments represented in the description in conjunction with the drawing.

BRIEF DESCRIPTION OF THE DRAWINGS

The electrical connecting terminal according to the invention is described in the following in preferred exemplary embodiments and is represented diagrammatically in the drawing, in which.

DETAILED DESCRIPTION

Figure 1:
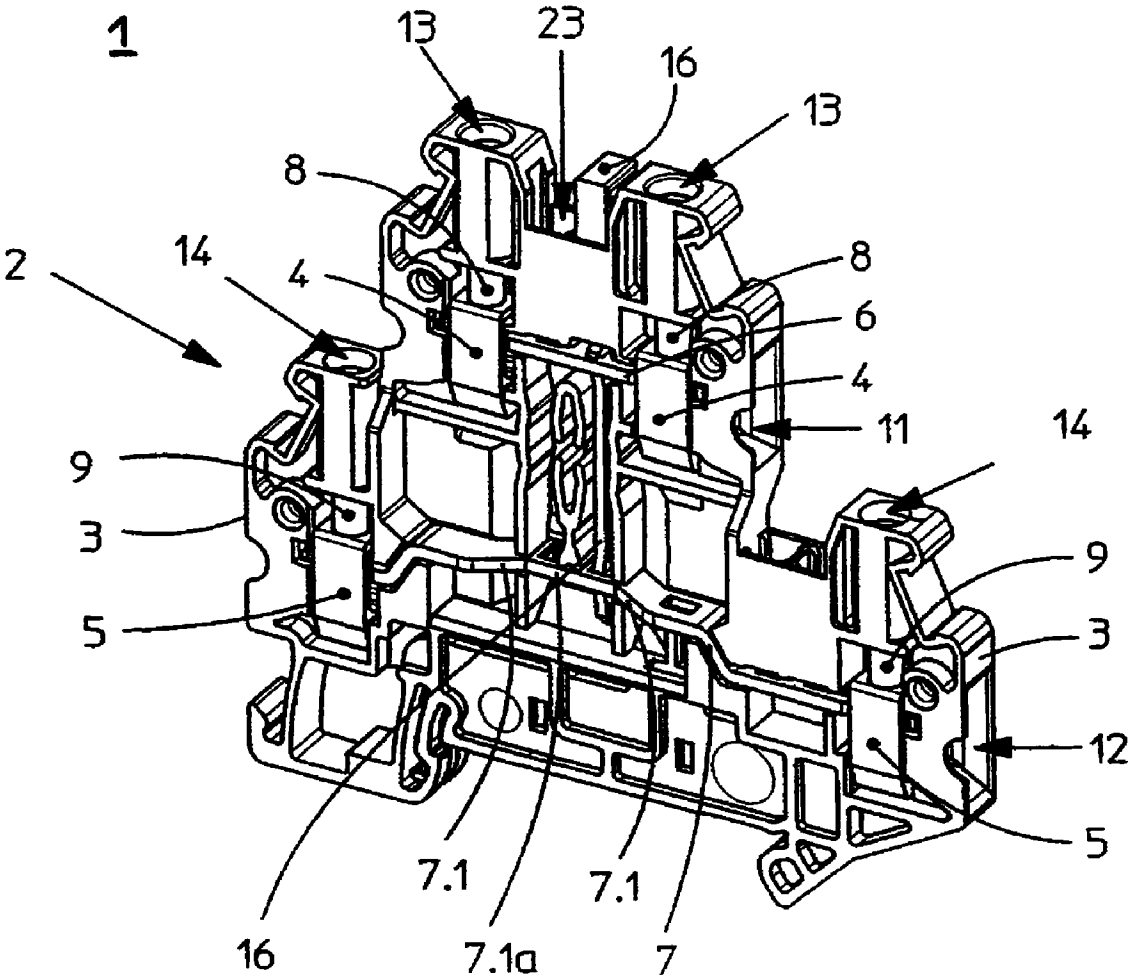
FIG. 1 shows essentially from the front, in a perspective view, an embodiment of an electrical connecting terminal with bus bars and conductor connections mounted and a potential connector plugged in from above.

FIGS. 1 to 4 show, as electrical connecting terminal (1), a series terminal with a connecting terminal housing (2) of plastic. The series terminal is designed in the manner of a double story, and for connecting conductor connections (4, 5) arranged on opposing narrow sides (3) of terminal housing (2) it has two bus bars (6, 7) arranged one above the other, with conductor connections (4, 5) connected electrically on the end sides. In this design bodies designed in the form of sockets, with screw connections (8, 9), are chosen as conductor connections (4, 5). Obviously, as an alternative to this, any other conductor connection methods of prior art may be used. Conductors may be inserted in the socket holes through the openings (11, 12) provided on the narrow side (3) of the terminal housing (2), which conductors can then be safely connected electrically to the bus bars (6, 7) by a known method by screw connections (8, 9) accessible through the holes denoted by 13, 14, an fixed in their position.

Figure 2:
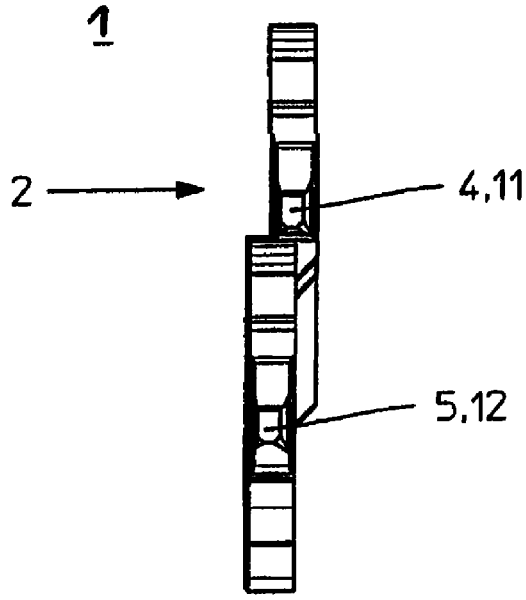
FIG. 2 shows the electrical connecting terminal in FIG. 1, in side elevation.
Figure 5:
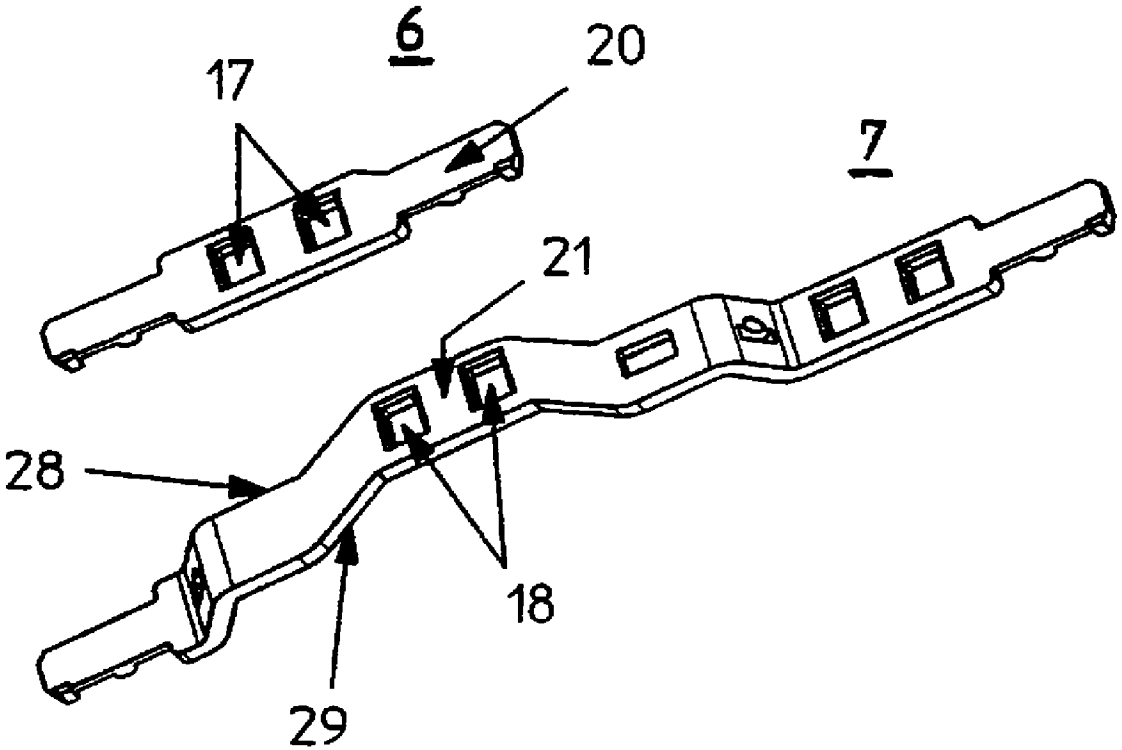
FIG. 5 shows, in a perspective view, the lower bus bar and upper bus bar running above the connecting terminal in FIG. 4.

As FIG. 2 shows, conductor connections (4, 5) of the two bus bars (6, 7), and the associated openings (11, 12) of terminal housing (2), are arranged laterally offset to each other, viewed in the longitudinal direction of the parallel running upper and lower bus bars (6, 7). Bus bars (6, 7) are also arranged offset to each other on the end side, viewed in their longitudinal direction. Central region (7.1) of lower bus bar (7) is laterally curved in its longitudinal direction. The curve is designed in the form of an offset. It is guided to the side of the housing wall denoted by 15 (see FIG. 3). In a central section (7.1*a*) of the central region (7.1) of the bus bars (6, 7), their vertical planes of symmetry, viewed in the longitudinal direction, preferably lie flush with each other. In this embodiment the bus bars (6, 7) match in terms of their width, so that their bus bar edges (28, 29), shown in particular in FIG. 5, also lie flush with each other in central section (7.1*a*) in a vertical plane, not shown, and are the same distance from the vertical plane of symmetry. It should also be pointed out that the curve of bus bar (7) is not necessarily provided throughout its width, as shown in FIG. 1. It is conceivable, for example, for the bus bar (7) to have an offset in the central region (7.1), as shown in FIG. 1, related to its longitudinal direction, where a bus bar edge runs in correspondence with the offset in the direction of a housing wall, whilst the opposite bus bar edge is not guided curvilinearly, but rectilinearly, i.e. in the longitudinal direction.

In the central region (7.1) of lower bus bar (7) housing wall (15) has a bulge (24) in the nature of a shaft with a trapezoid cross-section. This bulge (24) provides installation space and volume for receiving electrical, and in particular voluminous, components.

The bus bars (6, 7) are connected electrically by means of an electrical component. Typical electrical components include, for example, diodes and luminous displays for signaling voltage strength. A potential connector (16), according to the embodiments shown in FIGS. 1 and 4, which consists at least partially of an electrically conducting flat material, is preferably used as the electrical component of connecting terminal (1).

Figure 4:
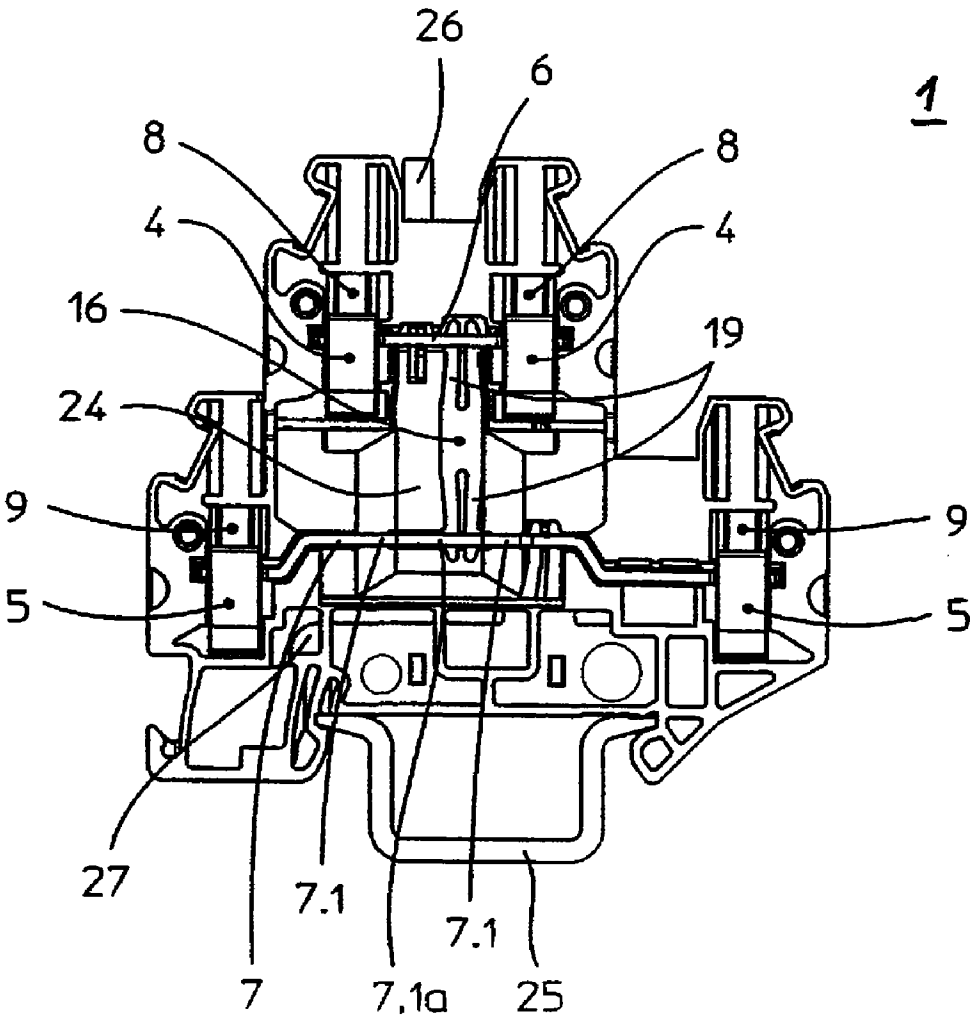
FIG. 4 shows an electrical connecting terminal with a connecting terminal housing, bus bars and conductor connections according to FIGS. 1, 2 and 3, but with a pre-assembled potential connector.

A plate running rectilinearly in its longitudinal direction, which contacts both bus bars (6, 7) in their central region (7.1, 8*a*), is used as the potential connector (16), as shown in FIG. 4. All conceivable electrical connection methods, such as soldering, screw, clamping, can be used for the electrical contacting of the potential connector (16). In the embodiments shown (see in particular FIGS. 1 and 4), potential connectors (16) are connected to bus bars (6, 7) by clamp connections. The clamp connections are formed by vertically flush plug openings (17, 18) between bus bars (6, 7) (see FIG. 5), in which potential connector (16) designed with fork-shaped expanding legs (19), engages. Here vertically flush plug openings (17, 18) refer to plug openings (17, 18) which are arranged on a straight line (not shown) running perpendicularly to the bus bar surfaces denoted by 20, 21 and shown in FIG. 5.

Figure 3:
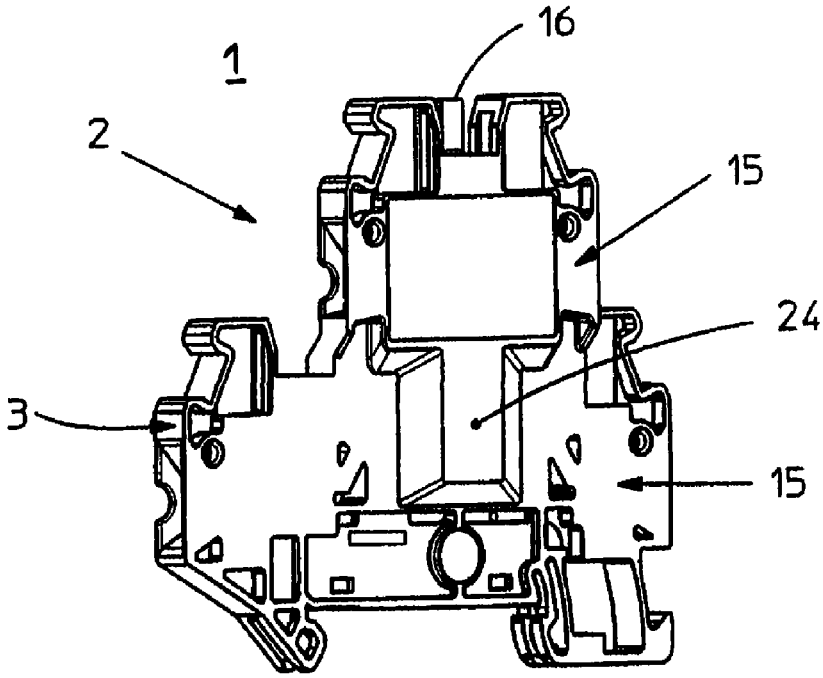
FIG. 3 shows the electrical connecting terminal in FIGS. 1 and 2, viewed essentially from the rear, in a perspective view.

To ensure that a potential connection and test facility can easily be installed between bus bars (6, 7) after the assembly of a series terminal on a support rail (25) such as that shown in FIG. 4, for example, connecting terminal housing (2) is provided, as shown in FIGS. 1 to 3, with plug openings (23) accessible from above, which openings lie vertically flush with plug openings (17, 18) of bus bars (6, 7).

In addition to potential connector (16) shown in FIG. 1, which is detachably plugged in, a bridging device (26) can obviously engage in plug openings (17, 18) provided and hence make the electrical contact with a series terminal arranged adjacent to it, for example, on the support rail (see FIG. 4). In this case any connection method is obviously possible, such as connection between the bus bars (6, 7) of the series terminal, and the connection of one or more bus bars of one or more other series terminals.

For simple connection of a potential grounding foot (27) to one or more bus bars (6, 7) it is also conceivable for the potential foot (27) to have openings, not shown, that are vertically flush with plug openings (17, 18). This enables an electrical component to be inserted in the terminal from above, through plug opening (23) of connecting terminal housing (2), in order to make any electrical connection between potential grounding foot (26) and one or more bus bars (6, 7).

The invention claimed is:

1. An electrical connecting terminal comprising:

a connecting terminal housing having a wide side, opposing narrow sides, and a housing wall on the wide side;

a plurality of bus bars disposed one above the other in the housing and connectable to each other by an electrical component;

a plurality of conductor connections disposed at the opposing sides of the connecting terminal housing and arranged laterally offset from one another in a longitudinal direction of the bus bars, wherein the bus bars are configured to connect the conductor connections, and wherein at least one bus bar is curved along in its length between the conductor connections in a direction of the housing wall.

2. The electrical connecting terminal as recited in claim 1, wherein the plurality of bus bars each include plug openings disposed vertically flush with each other.

3. The electrical connecting terminal as recited in claim 1, wherein the at least one bus bar is curved in the form of an offset.

4. The electrical connecting terminal as recited in claim 1, wherein the at least one bus bar is curved in a central region of the at least one bus bar.

5. The electrical connecting terminal as recited in claim 1, wherein the electrical component is connected electrically to the bus bars and includes an electrically conducting flat material.

* * * * *